United States Patent [19]

Naganawa

[11] 4,183,578

[45] Jan. 15, 1980

[54] ELECTRICALLY OPERATED WHEELED CHAIR FOR PHYSICALLY HANDICAPPED PERSONS

[75] Inventor: Masahiro Naganawa, Kakami-nishi, Japan

[73] Assignee: Imasen Electric Co., Ltd., Japan

[21] Appl. No.: 891,201

[22] Filed: Mar. 29, 1978

[51] Int. Cl.[2] ..... A47C 1/02

[52] U.S. Cl. ..... 297/90; 297/DIG. 4; 297/330

[58] Field of Search ..... 297/DIG. 4, 90, 91, 297/330

[56] References Cited

U.S. PATENT DOCUMENTS

| | | | |
|---|---|---|---|
| 343,216 | 6/1886 | Young | 297/90 |
| 2,676,643 | 4/1954 | Miller et al. | 297/DIG. 4 |
| 2,913,738 | 11/1959 | Wise | 297/DIG. 4 |
| 3,147,039 | 9/1964 | Smith et al. | 297/90 |
| 3,476,495 | 11/1969 | Church | 297/90 X |

FOREIGN PATENT DOCUMENTS

| | | | |
|---|---|---|---|
| 6712316 | 3/1969 | Netherlands | 297/DIG. 4 |

*Primary Examiner*—James T. McCall

*Attorney, Agent, or Firm*—Holman & Stern

[57] ABSTRACT

An electrically operated wheeled chair for physically handicapped persons comprising a framework with casters, arm rests on the upper side of said framework, a back rest pivoted at a point provided at the upper and rear corner of the framework, an inclined rocking pipe pivoted at a point provided at the upper and front corner of the framework and telescopically receiving a foot pipe and control box mounted movably in back and forth on an upper horizontal part of the framework. As the back rest moves toward a substantially horizontal position, a seat cushion moves upwardly to a level at which arm rests lie. The foot pipe extends as it tilts. The seat cushion moves backwardly as it rises. The control box moves backwardly along the arm rests as the back rest tilts backwardly.

4 Claims, 6 Drawing Figures

ELECTRICALLY OPERATED WHEELED CHAIR FOR PHYSICALLY HANDICAPPED PERSONS

BACKGROUND OF THE INVENTION

This invention relates to an electrically operated wheeled chair for physically handicapped persons of the type in which as a back rest and a foot pipe tilt to a substantially horizontal position, a seat cushion moves up and at last the three parts reach substantially the same level as arm rests. The foot pipe extends as the pipe moves upwardly. The seat cushion retracts as the cushion moves upwardly. A control box moves rearwardly along the length of the arm rests as the back rest tilts rearwardly.

This invention relates to improvements in the seat portion of an electrically operated wheeled chair for physically handicapped persons.

In the prior art electrically operated wheeled chair of the above type, the physically handicapped person seating in the chair can be tilted to the supine position by tilting the back rest rearwardly to a horizontal position and also pivoting the foot pipe to a substantially horizontal position.

However, in the conventional electrically operated wheeled chair of the above type, when the physically handicapped person is transferred from the wheeled chair maintained in the horizontal position to a bed and vice versa, the arm rests stand in the way to thereby make it difficult to transfer the person between the bed and chair.

Furthermore, in the conventional wheeled chair of the above type, since the foot pipe is pivoted at the upper end to the front end of the seat, even when the back rest is tilted rearwardly and the foot pipe is moved upwardly, the length of the foot pipe remains unchanged. However, when a physically handicapped person seats in the chair, the kneecap of the person projects beyond the pivot point of the foot pipe to the front end of the seat. Therefore, when the foot pipe moves upwardly and the back rest tilts rearwardly, the feet of the person is subjected to compressive pressure from the foot plate of the foot pipe to the degree that the person can not extend his legs.

Furthermore, in the conventional wheeled chair of the above type, since the frame of the back rest is directly pivoted in a lower portion of the frame to the rear end of the seat cushion, as the physically handicapped person seating in the chair changes his posture from a normal seating position to a supine position, the garment put on an upper portion of his body creeps On the other hand, as he restores his posture from the supine position to the normal seating position, the garment put on the upper portion of his body slips down and his abdominal region is subjected to pressure resulting in increasement of load on the part of the attendant who cares for the physically handicapped person.

Furthermore, in the wheeled chair of the above type, it is preferable that not only the attendant, but the physically handicapped person himself also can operate the control boxes to change the latter's posture.

SUMMARY OF THE INVENTION

Therefore, the present invention provides a novel and improved wheeled chair for physically handicapped person which can effectively eliminate the disadvantages inherent in the conventional wheeled chairs referred to hereinabove.

One object of the present invention is to provide a wheeled chair for physically handicapped persons in which when the back rest and foot pipe are tilted to a substantially horizontal position, the seat cushion moves upwardly to a position in which the arm rests are not in the way.

Another object of the present invention is to provide a wheeled chair for physically handicapped persons in which even when the back rest tilts rearwardly and the foot pipe moves upwardly, the person seating in the chair can freely extend his legs without his feet being subjected to pressure from the foot plate.

Another object of the present invention is to provide a wheeled chair for physically handicapped persons in which when the person seating in the chair changes his posture from a seating position to a substantially horizontal position and vice versa, any creep and/or slip of the garment will not occur.

A further object of the present invention is to provide a wheeled chair for physically handicapped persons in which as the back rest tilts rearwardly and the foot pipe moves upwardly, the control box moves rearwardly along the length of the arm rests whereby the person can easily access to the control boxes even when the person seating in the chair is in the supine position.

The above and other objects and attendant advantages of the present invention will be more readily apparent to those skilled in the art from a reading of the following detailed description in conjunction with the accompanying drawings which show one preferred embodiment of the invention for illustration purpose only, but not for limiting the scope of the same in any way.

PREFERRED EMBODIMENT OF THE INVENTION

The present invention will be now described referring to the accompanying drawings which show one preferred embodiment of the invention for illustration purpose only, but not for limiting the scope of the same in any way.

Figure 1:
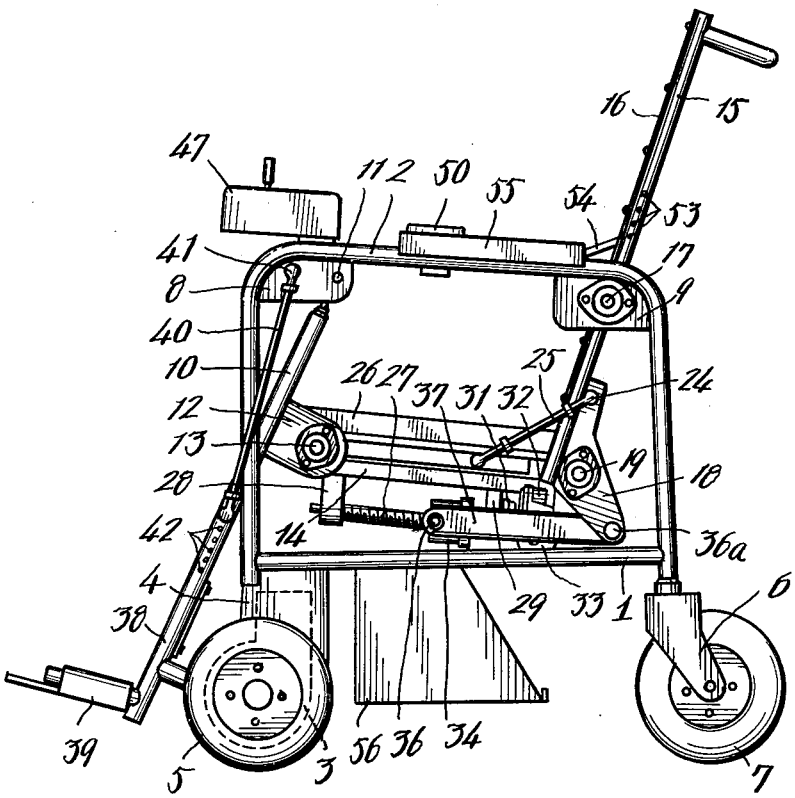
FIG. 1 is a schematic side elevational view of one preferred embodiment of electrically operated wheeled chair for physically handicapped persons constructed in accordance with the present invention.
Figure 2:
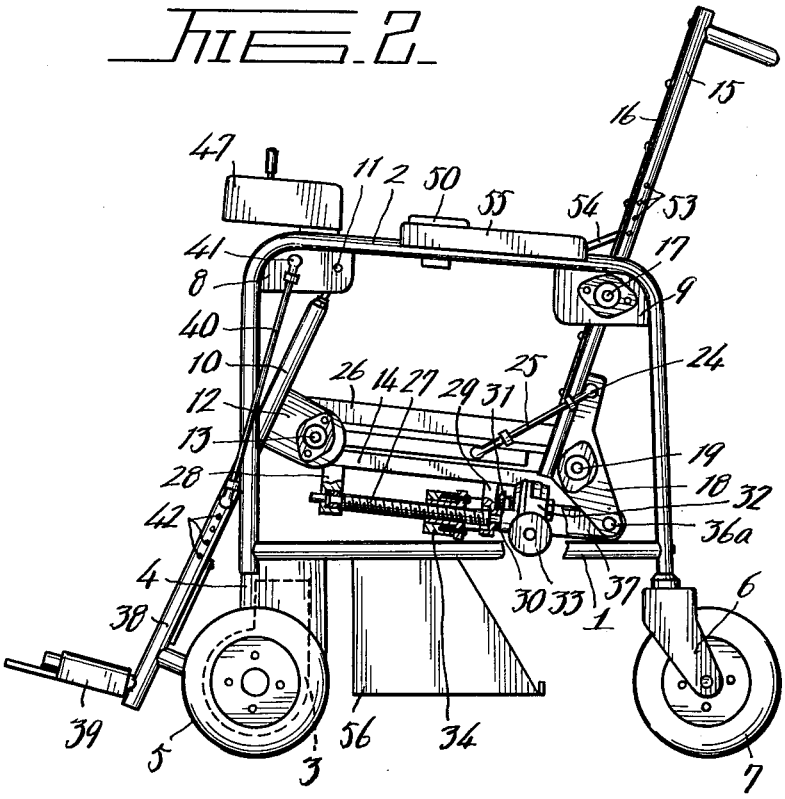
FIG. 2 is similar to FIG. 1, but shows said wheeled chair with a portion thereof broken and a portion thereof in section.

The mechanical components of the electrically operated wheeled chair for physically handicapped persons of the invention are arranged in symmetrical relationship with respect to the vertical center line or axis. Thus, description will be made of the arrangement of the mechanical components which constitute on half portion of the two symmetrical half portions of the wheeled chair with the understanding that the description is equally applicable to the arrangement of mechanical components which constitute the other symmetrical half portion. In FIGS. 1 and 2 reference numeral 1 denotes a substantially horizontal base frame and the opposite ends of the base frame are fixedly secured to the lower ends of the legs of an upright frame 2 having a substantially inverted U-shape. The extreme lower ends of the legs of the U-shaped frame 2 extend downwardly beyond the opposite ends of the base frame 1 for the purpose to be described hereinbelow. The lower extension of the front leg of the frame (the left-hand leg as seen in FIGS. 1 and 2) supports a drive or front castor 5 through a mounting member 4 which is provided with an electric drive motor 3 and the lower extension of the rear leg of the frame 2 (the right-hand leg as seen in FIGS. 1 and 2) supports a follower or rear castor 7 through a yoke 6 which is rotatably mounted on the lower extension of the rear leg of the frame 2. The frames 1, 2 and castors 5, 7 constitute the frame work of the wheeled chair of the invention in cooperation with the corresponding mechanical components of the other symmetrical half portion.

Front and rear brackets 8 and 9 are fixedly secured to the inner side of the upright frame 2 at the junctions between the upper ends of the front and rear legs and the opposite ends of the intermediate portion of the upright frame 2, respectively.

Reference numeral 10 denotes a rocking pipe the upper end of which is pivoted to the front bracket 8 at 11 whereas the lower end of which has a bracket 12 fixedly secured thereto. A seat base 14 (FIG. 4) is pivoted at the front end thereof to the bracket 12 at 13.

Figure 4:
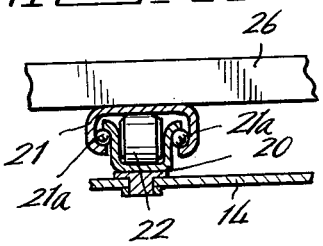
FIG. 4 is a fragmentary cross-sectional view on an enlarged scale of the upper and lower seat rails.
Figure 3:
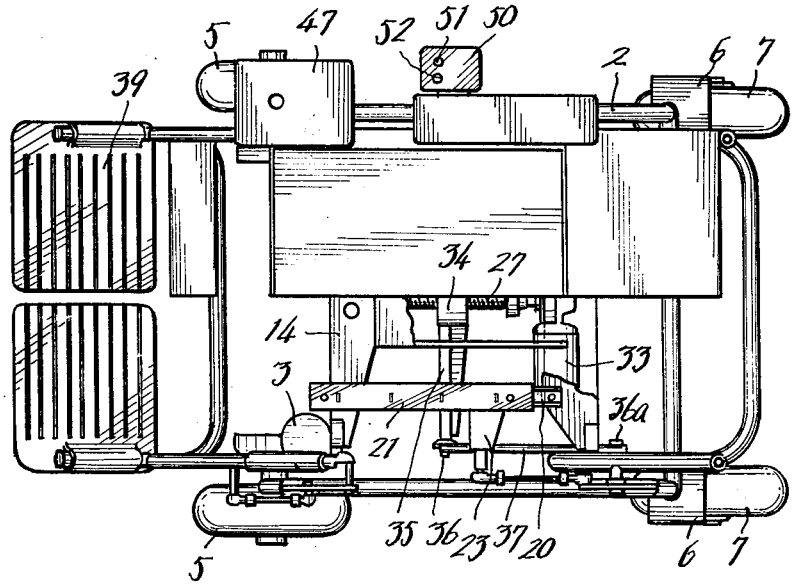
FIG. 3 is a plan view of said wheeled chair showing one half portion thereof in section.

Reference numeral 15 denotes a back rest frame across which a sheet 16 forming the back rest extends and the back rest frame is pivoted at intermediate point to the rear bracket by means of a pivot pin 17. The lower end of the back rest, frame 15 has a bracket 18 fixedly secured thereto:

The seat base 14 is pivoted at the rear end to the bracket 18 and 19. Two lower seat rails 20 are fixedly secured to the upper surface of the seat base 14 in parallel and spaced relationship to each other (only one lower seat rail 20 is shown in FIGS. 3 and 4). The lower seat rails 20 have a substantially U-shaped cross section with the opposite legs extending upwardly and outwardly. A substantially inverted U-shaped cross section upper seat rail 21 is mounted on each of the lower seat rails 20 for slidable movement along the length of the lower seat rail with the opposite legs of the upper seat rail extending downwardly and inwardly to embrace the opposite legs of the lower seat rail 20. A seat cushion 26 is fixedly mounted on the upper seat rail 21 for movement with the rail. Steel balls 21*a* are interposed between the cooperating legs of the lower and upper seat rails 20, 21. A plurality of spaced rollers 22 (only one roller 22 is shown in FIG. 4) are interposed between the lower and upper seat rails 20, 21 to guide the upper seat rail 21 in its slidable movement along the length of the associated lower seat rail. The upper seat rail 21 has a laterally extending bracket 23 fixedly secured thereto.

A connection rod 25 is secured at the one end to the bracket 23 and pivoted at the other end to the lower bracket 18 at 24 whereby as the back rest unit 15, 16 tilts rearwardly or rightwards as seen in FIGS. 1 and 2, the upper rails 21 and accordingly, the seat cushion 26 on the upper rails 21 moves rearwards or rightwards as seen in FIGS. 1 and 2. However, it is to be understood that means other than the bracket 23 and connection rod 25 may be also employed to provide the same effect, that is, the arrangement that seat cushion 26 moves rearwardly as the back rest unit 15, 16 tilts rearwardly.

Reference numeral 27 denotes a screw which is rotatably received in a pair of spaced front and rear annular support members 28, 29 which are in turn secured to the undersurface of the seat base 14 for rotation and bearing against thrust load and the screw 27 is operatively connected to a seat lifting and lowering motor 33 through gears 30, 31 and a reduction gear 32.

Reference numeral 34 denotes a nut member which is in threaded with the screw and positioned between the front and rear support members 28, 29 and the nut member 34 has an extension 35 extending therefrom. The free end 36 of the extension 35 is rotatably connected by a connection plate 37 the other end of which is pivoted to the bracket 18 at 36*a*.

Reference numeral 38 denotes a foot pipe which has a foot plate 39 secured to and extending forwardly of the lower end of the foot pipe at substantially right angles thereto and the upper end of the foot pipe is telescopically received in the rocking pipe 10.

Reference numeral 40 denotes a connection rod the upper end of which is pivoted to the upper front bracket 8 at 41 positioned forwardly of the pivot pin 11 whereas the lower end of which is adapted to selectively engage in a selected one of a plurality of spaced adjusting holes 42 provided in the center portion of the foot pipe 38.

Figure 5:
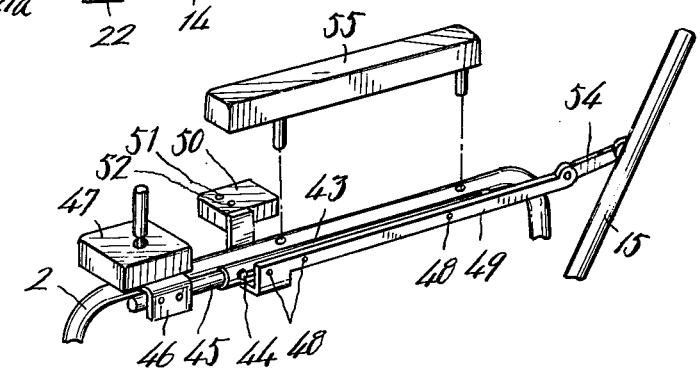
FIG. 5 is a perspective view on an enlarged scale of the control box.

Reference numeral 43 (FIG. 5) denotes a pipe fixedly secured to the upright frame 2 and having an elongated slot 44 which extends by a substantial distance between the opposite ends of the pipe 43 and a slidable rod 45 is movably received in the pipe 44. The front end of the slidable rod 45 has a L-shaped or angle plate 46 to which a control box 47 is fixedly secured for controlling the speed and direction of the wheeled chair. A connection plate 49 is fixedly secured to the rod 45 at spaced points along the length of the rod 43 by means of screws 48 whereby the rod 45 is freely slidably within the pipe 43 as the connection plate 49 is moved in the manner as will be described hereinafter.

The front end of the connection plate 49 is formed with a substantially U-shaped bracket and a control box 50 for moving the seat cushion 26 upwardly and downwardly is secured to one of the opposite legs of the bracket.

Switches 51 and 52 are provided in the control box 50 and the former switch is for lifting the seat cushion 26 and the latter switch is for lowering the seat cushion.

The above-mentioned back rest frame 15 is provided with a plurality of spaced adjusting holes 53 in the center portion between the upper and lower ends of the frame and a connection rod 54 is pivoted at one end to the rear end of the connection plate 49 and freely received at the other end in a selected one of the adjusting holes 53. Reference numeral 55 denotes an arm rest mounted on the upright frame 2 and reference numeral 56 denotes a casing for secured to the undersurface of the seat base 1 for housing a power source (not shown) and a control circuit (not shown).

In operation, when the lifting switch 51 in the control box 50 is depressed down, electric current is supplied from the power source (not shown) to the motor 33 to energize the motor. The energization of the motor 33 rotates its output shaft (not shown) and the rotation force of the motor output shaft is transmitted through the reduction gear 32 and gears 31, 32 to the screw 27 whereupon the nut member 34 which is in threaded engagement with the screw 27 advances along the screw while rotating about the latter. As the nut member 34 advances in the manner mentioned above, the nut member 34 pulls the lower rear bracket 18 forwardly through the extension 35 of the nut member and connection plate 37. As the bracket 18 is pulled forwardly, the bracket pivots in the clockwise direction as seen in FIGS. 1 and 2 about the pivot point 19 to thereby tilt the back rest unit 15, 16.

Since the upper intermediate portion connecting between the legs of the upright frame 2, back rest frame 15, seat base 1 and rocking pipe 10 provide a parallelogram having its apices at the respective pivot points 11, 17, 19 and 13, the force which acts on the back rest 15, 16 to tilt the same lifts and seat base 14 and rocking pipe 10 at a forwardly inclining angle.

Figure 6:
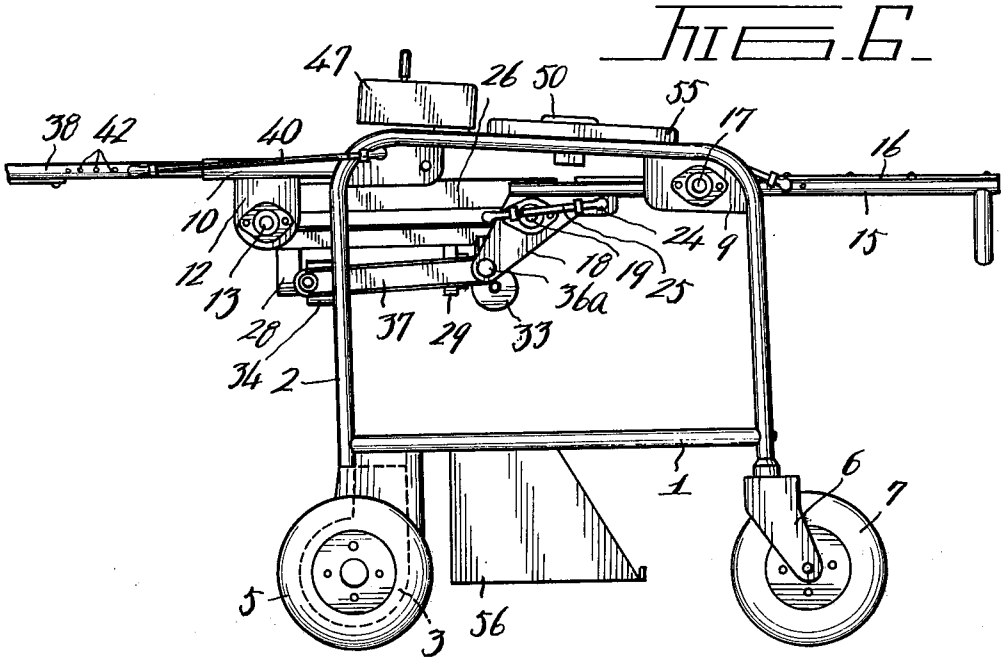
FIG. 6 is a schematic side elevational view of said electrically operated wheeled chair showing the seat cushion, back rest and foot pipe of the chair in horizontal position.

The upwardly and forwardly inclining movement of the seat base 14 and rocking pipe 10 continues until the back rest 15, 16, seat suchion 26 and foot pipe 38 assume the positions as shown in FIG. 6 in which the back rest, seat cushion and foot pipe lie in substantially horizontal planes.

During the upwardly and forwardly inclining movement of the seat base 14 and rocking pipe 10 in the manner mentioned hereinabove, the upper seat rail 21 adapted to slidably move along the associated lower seat rail 20 is pulled backwardly by the pivoting bracket 18 through the bracket 23 secured to the upper seat rail and the connection rod which connects between the brackets 18, 23 and thus, the upper seat rail 21 retracts along the associated lower seat rail 20.

And since the connection rod 40 is freely received at one end in a selected one of the plurality of adjusting holes 42 in the foot pipe 38 and pivotably connected at the other end to the upper front bracket 8, as the rocking pipe 10 pivots upwardly or in the clockwise direction as seen in FIGS. 1 and 2 about the pivot point 11, the foot pipe 38 extends out of the rocking pipe 10.

And as the back rest unit 15, 16 tilts rearwardly, the control boxes 47, 50 move rearwardly through the carriage mechanism provided by the connection rod 54, connection plate 49 slidable rod 45 and U-shaped bracket 46.

The operation of the wheeled chair of the invention as described hereinabove may be summerized as follows:

When the lifting switch 51 is depressed down, the back rest unit 15, 16 tilts rearwardly, the seat cushion 26 moves upwardly and also moves rearwardly with respect to the seat base 14, the foot pipe 38 moves upwardly and forwardly and also extends out of the rocking pipe 10 and the control boxes 47, 50 move rearwardly.

On the other hand, when the lowering switch 52 is depressed down, the above mentioned operation order is reversed. In this case, the back rest unit 15, 16 returns to its substantially upright position, the seat cushion 26 moves downwardly and also moves forwardly with respect to the seat base 14, the foot pipe 38 returns to its substantially upright position and also retracts into the rocking pipe 10 and the control boxes 47, 50 move forwardly to their initial positions, respectively.

The features of the wheeled chair for physically handicapped persons of the invention are as follows:

1. As the back rest moves to a substantially horizontal position, the seat cushion moves upwardly to substantially the same height as that of the arm rests.

2. As the back rest moves to the substantially horizontal position, the foot pipe also moves to a substantially horizontal position.

3. As the foot pipe tilts, the pipe extends out of the rocking pipe in which the foot pipe is telescopically received.

4. As the seat cushion moves upwardly, the seat cushion retracts and as the seat cushion moves downwardly, the seat cushion advances.

5. As the back rest tilts rearwardly, the control boxes move rearwardly along the arm rests.

While only one embodiment of the invention has been show and described in detail, it will be understood that the same is for illustration purpose only and not to be taken as a definition of the invention, reference being had for the purpose to the appended claim.

What is claimed is:

1. An electrically operated wheeled chair for physically handicapped persons comprising a framework with casters, at least one arm rest mounted on the upper side of said framework, a back rest unit pivoted in an intermediate position between opposite ends thereof to a first pivot point provided at the upper and rear corner of said framework, an inclined rocking pipe pivoted to a second pivot point provided at the upper and front corner of said framework, a seat base unit pivoted at one end to a third pivot point provided at the lower end of said back rest unit and at the other end to a fourth pivot point connected to the lower end of said rocking pipe and adapted to move upwardly and downwardly up to the height of said arm rest when said back rest unit is tilted to a substantially horizontal position, a seat lifting and lowering means having annular support members secured to said seat base unit for rotatably supporting a screw which is operatively connected to a motor secured to said seat base unit and a nut member being in threaded engagement with said screw, said nut having an extension operatively connected to a fifth pivot point provided at the lower end of said back rest unit by means of a connection plate.

2. The wheeled chair for physically handicapped persons as set forth in claim 1, said rocking pipe slidably receiving therein a foot pipe, means for operating telescopic movement of said foot pipe and having a plurality of adjusting holes in said foot pipe and a connection rod selectively engaging at one end with one of said adjusting holes and at other end connected to a sixth pivot point provided at the front and rear corner of said framework and in a position forwardly of said second pivot point.

3. The wheeled chair for physically handicapped persons as set forth in claim 1, said seat base unit comprising a seat sliding means having at least one lower seat rail secured thereto, an upper seat rail engagement with said lower seat rail for slidable movement back and forth along the lower seat rail, a seat cushion secured to the upper surface of said upper seat rail and means for moving said seat cushion backwardly as said back seat unit tilts rearwardly.

4. The wheeled chair for physically handicapped persons as set forth in claim 1, said chair comprising at least one control box mounted movably in back and forth on an upper horizontal part of said framework and having a seat lifting switch and seat lowering switch, a plurality of adjusting holes provided in said back rest unit, a connection rod selectively engaging at one end with one of said adjusting holes and at other end connected to said control box.

* * * * *